US010233751B2

(12) United States Patent
Magee et al.

(10) Patent No.: US 10,233,751 B2
(45) Date of Patent: Mar. 19, 2019

(54) TOOL ADAPTER FOR A ROTARY TOOL

(71) Applicant: Caterpillar Paving Products Inc., Brooklyn Park, MN (US)

(72) Inventors: Kevin James Magee, Buffalo, MN (US); Mario Persano, Poggio Renatico (IT); Dario Sansone, Castello d'Argile (IT)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 53 days.

(21) Appl. No.: 15/489,921

(22) Filed: Apr. 18, 2017

(65) Prior Publication Data

US 2018/0297236 A1 Oct. 18, 2018

(51) Int. Cl.

| | |
|---|---|
| ***E21C 35/18*** | (2006.01) |
| ***B28D 1/18*** | (2006.01) |
| ***E21C 35/197*** | (2006.01) |
| *E01C 23/12* | (2006.01) |
| *E01C 23/088* | (2006.01) |

(52) U.S. Cl.

CPC ..... *E21C 35/18* (2013.01); *B28D 1/186* (2013.01); *E21C 35/197* (2013.01); *E01C 23/088* (2013.01); *E01C 23/127* (2013.01)

(58) Field of Classification Search

CPC ..... E21C 35/18

See application file for complete search history.

(56) References Cited

U.S. PATENT DOCUMENTS

| | | | | |
|---|---|---|---|---|
| 6,099,081 | A * | 8/2000 | Warren | E21C 35/187 299/104 |
| 8,118,371 | B2 * | 2/2012 | Hall | E21C 35/183 299/102 |
| 8,292,372 | B2 * | 10/2012 | Hall | E21C 35/18 299/102 |
| 8,360,699 | B2 | 1/2013 | Stojanovski | |
| 8,449,040 | B2 | 5/2013 | Hall et al. | |
| 8,523,290 | B2 | 9/2013 | Kennametal | |
| 8,770,669 | B2 | 7/2014 | Bomag | |
| 8,911,024 | B2 * | 12/2014 | Fundakowski | E01C 23/088 299/102 |
| 8,950,821 | B2 * | 2/2015 | Fundakowski | E21C 25/10 299/39.8 |
| 9,163,502 | B2 | 10/2015 | Wirtgen | |
| 2002/0167216 | A1 | 11/2002 | Sollami | |

(Continued)

FOREIGN PATENT DOCUMENTS

| | | | |
|---|---|---|---|
| DE | 102011079115 | A1 | 1/2013 |
| DE | 102013112973 | A1 | 5/2015 |

(Continued)

*Primary Examiner* — Janine M Kreck

(74) *Attorney, Agent, or Firm* — Law Office of Kurt J. Fugman LLC

(57) ABSTRACT

A tool adapter comprises a body including at least one elongated portion defining a longitudinal axis, a first end and a second end disposed along the longitudinal axis, a flange disposed between the first and second ends along the longitudinal axis, and an exterior surface extending along the longitudinal axis, and a collar portion defining a collar outer surface and the body defines a first groove disposed adjacent the first end extending along the longitudinal axis on the outer collar surface along the majority of the longitudinal length of the collar portion.

18 Claims, 8 Drawing Sheets

(56) References Cited

U.S. PATENT DOCUMENTS

| | | | | |
|---|---|---|---|---|
| 2004/0174065 | A1* | 9/2004 | Sollami | B28D 1/188 299/106 |
| 2010/0045094 | A1 | 2/2010 | Sollami | |
| 2014/0346841 | A1* | 11/2014 | Wachsmann | B28D 1/188 299/77 |
| 2015/0137579 | A1 | 5/2015 | Lachmann et al. | |
| 2015/0240634 | A1* | 8/2015 | Sollami | E21C 35/18 299/102 |
| 2017/0073940 | A1 | 3/2017 | Flahive et al. | |
| 2017/0198579 | A1* | 7/2017 | Magee | E21C 25/10 |

FOREIGN PATENT DOCUMENTS

| | | |
|---|---|---|
| EP | 1000721 | 5/2000 |
| WO | 2013113062 A1 | 8/2013 |

* cited by examiner

TOOL ADAPTER FOR A ROTARY TOOL

TECHNICAL FIELD

The present disclosure relates to tool adapters used to attach tools such as cutting bits to rotary tools such as cutting drums used in milling machines, cold planer, and the like. Specifically, the present disclosure relates to a tool adapter with features that indicate or prevent wear, ease disassembly of the cutting bit from the tool adapter, or enhance rotation of the cutting bit.

BACKGROUND

Rotary tools such as cutting drums are routinely employed by milling machines such as cold planers and the like for ripping up a work surface such as soil, loose rock, asphalt, pavement, concrete, etc. As can be imagined, these rotary tools may use cutting bits adapted to perform the necessary work. These cutting bits are subject to wear. Therefore, it is often necessary to replace these cutting bits once worn. Alternatively, it may be desirable to change out one type of cutting bit for another type of cutting bit depending on the work material. For example, one cutting bit may be well adapted for ripping up concrete while another may be better suited for ripping up asphalt.

For these reasons, tool adapters (also referred to as tool holders) have been developed so that cutting bits may be changed without needing to replace the entire cutting drum. It is desirable that these tool adapters be durable, easy to service and very reliable. Improvements in any of these three traits helps to improve the overall efficiency of a machine using cutting bits and any associated construction, agricultural, mining or earthmoving operation and the like.

It has been observed that it is sometimes difficult to remove cutting bits from tool adapters that are currently known in the art. It has also been observed that wear and particularly uneven wear is sometimes detrimental to the efficiency of a machine using rotary tools. Furthermore, it has also been determined that some tool adapters are not has reliable as desired as their attachment to a rotary cutting tool may loosen over time due to vibration. Accordingly, a tool adapter that has better performance in any of these three categories whether it be reliability, ease of service, or durability is warranted.

SUMMARY

A tool adapter according to an embodiment of the present disclosure is provided. The tool adapter comprises a body including at least one elongated portion defining a longitudinal axis, a first end and a second end disposed along the longitudinal axis, a flange disposed between the first and second ends along the longitudinal axis, and an exterior surface extending along the longitudinal axis. The flange divides the body into a tool retaining portion disposed between the first end and the flange, and a tool adapter attaching portion disposed between the second end and the flange, and the body defines a tool receiving bore extending from the first end toward the second end along the longitudinal axis and a cylindrical collar portion disposed proximate the first end including an outer collar surface and at least one wear indicator disposed on the outer collar surface of the collar portion. The cylindrical collar portion defines a circumferential direction and a radial direction and the body defines a first groove and a second groove disposed adjacent and spaced away from the first end, the first and second groove extending along the longitudinal axis on the outer collar surface, said first and second grooves being spaced away from each other along a direction tangential to the circumferential direction. The tool adapter attaching portion includes a shank having a tapered portion disposed adjacent the flange along the longitudinal axis and a non-tapered portion disposed adjacent the second end along the longitudinal axis, the shank also defining a shank bore. The body further defines a cross-slot extending from the exterior surface to the tool receiving bore and a clearance groove disposed between the tapered portion and non-tapered portion along the longitudinal axis.

A tool adapter for attaching tools to a rotary tool according to an embodiment of the present disclosure is provided. The tool adapter comprises a body including at least one elongated portion defining a longitudinal axis, a first end and a second end disposed along the longitudinal axis, a flange disposed between the first and second ends along the longitudinal axis, and an exterior surface extending along the longitudinal axis. The flange divides the body into a tool retaining portion disposed between the first end and the flange, and a tool adapter attaching portion disposed between the second end and the flange, and the body defines a tool receiving bore extending from the first end toward the second end along the longitudinal axis and the tool retaining portion includes a collar portion defining a collar outer surface and the body defines a first groove disposed adjacent the first end extending along the longitudinal axis on the outer collar surface along the majority of the longitudinal length of the collar portion.

A tool adapter for attaching tools to a rotary tool according to an embodiment of the present disclosure is provided. The tool adapter comprises a body including at least one elongated portion defining a longitudinal axis, a first end and a second end disposed along the longitudinal axis, a flange disposed between the first and second ends along the longitudinal axis, and an exterior surface extending along the longitudinal axis. The flange divides the body into a tool retaining portion disposed between the first end and the flange, and a tool adapter attaching portion disposed between the second end and the flange, and the body defines a tool receiving bore extending from the first end toward the second end along the longitudinal axis and the tool adapter attaching portion includes a shank including a tapered portion and a non-tapered portion.

BRIEF DESCRIPTION OF THE DRAWINGS

The accompanying drawings, which are incorporated in and constitute a part of this specification, illustrate several embodiments of the disclosure and together with the description, serve to explain the principles of the disclosure. In the drawings.

Figure 3:
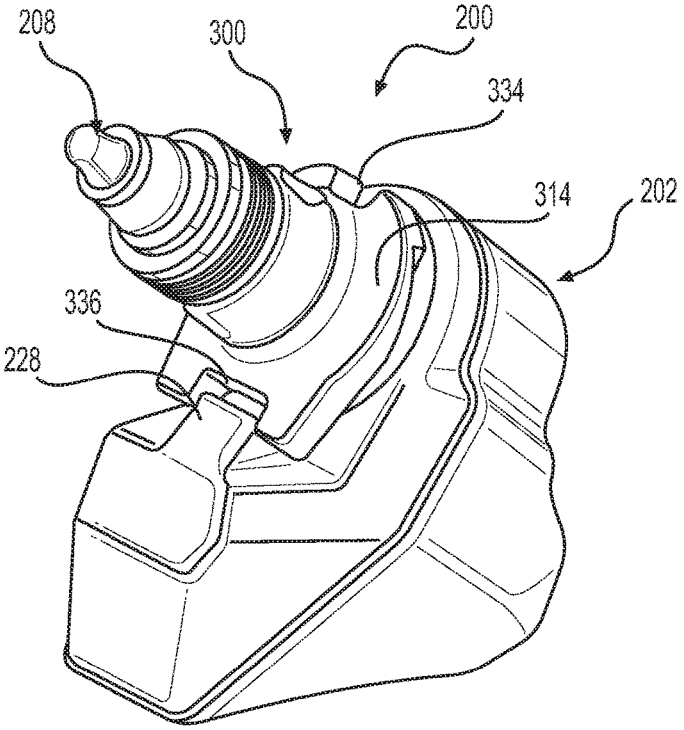
FIG. 3 is a perspective view of a cutting tool assembly removed from the rotary cutting drum assembly of FIG. 2.
Figure 4:
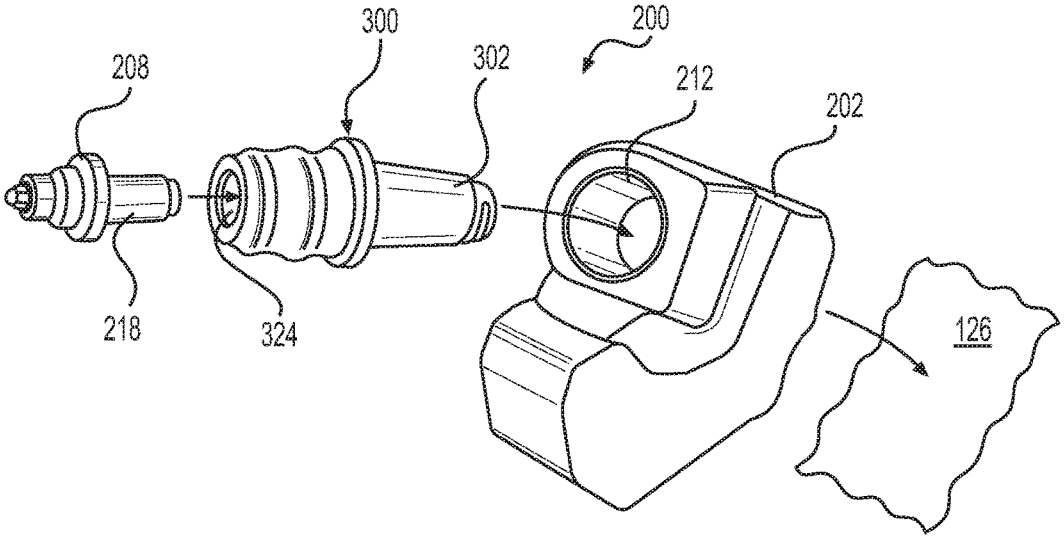
FIG. 4 is an exploded assembly view of the cutting tool assembly of FIG. 3.

3 and 4, illustrating the expansion and contraction of the spring loaded shank of the cutting tool bit subassembly, which is used to attach or detach the cutting tool bit from the tool adapter of the cutting tool assembly of FIGS. 3 and 4.

Figure 6:
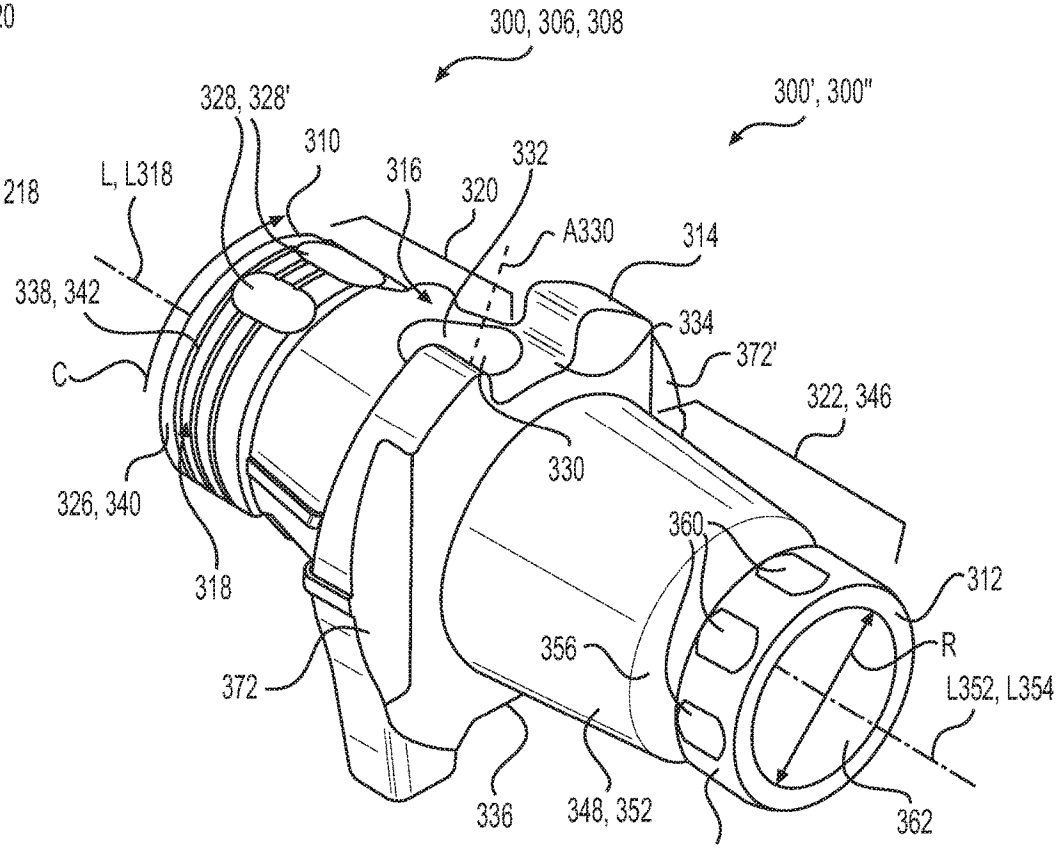

FIG. 6 is a perspective view of a tool adapter according to an embodiment of the present disclosure.

Figure 7:
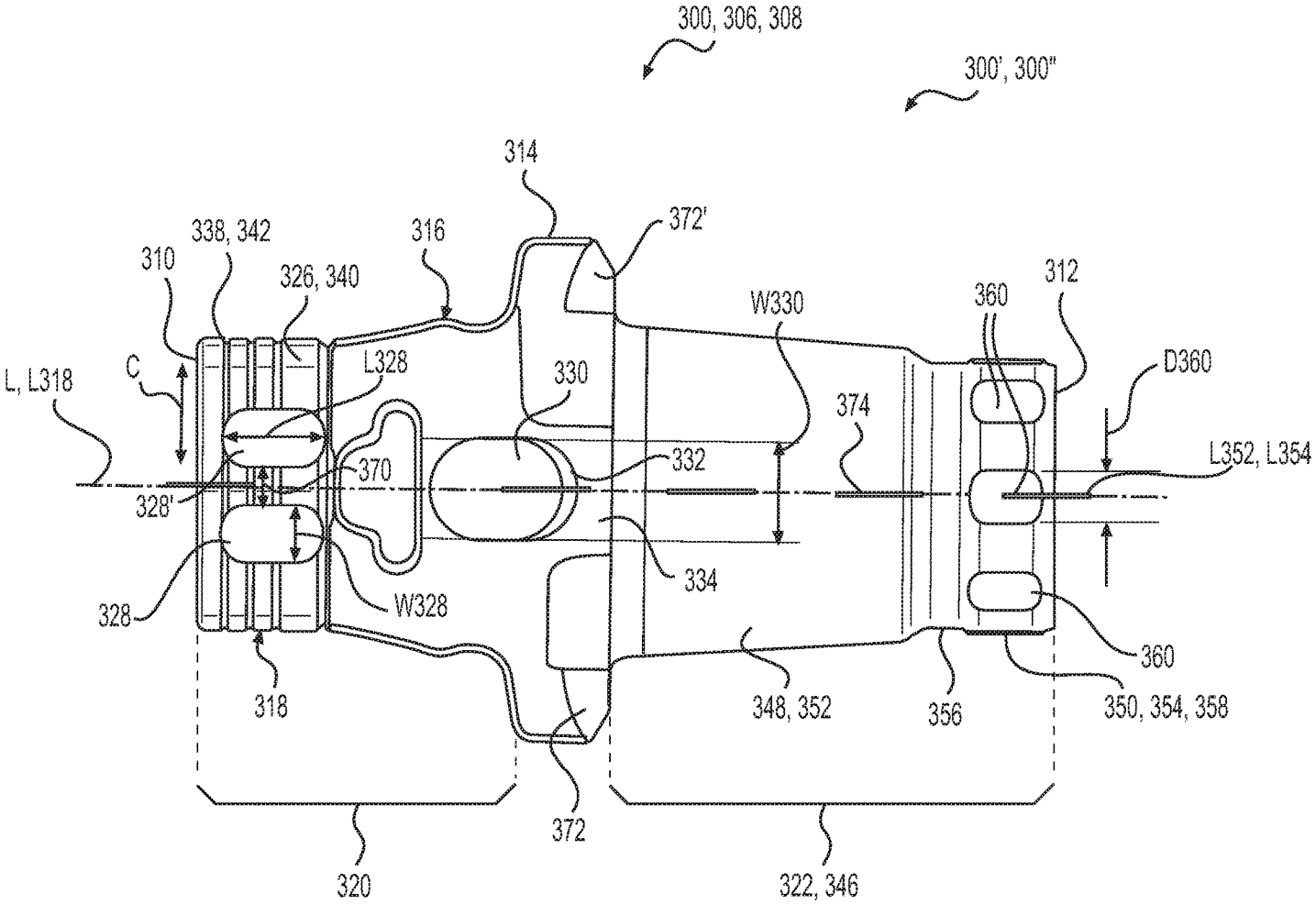

FIG. 7 is a top view of the tool adapter of FIG. 6.

Figure 8:
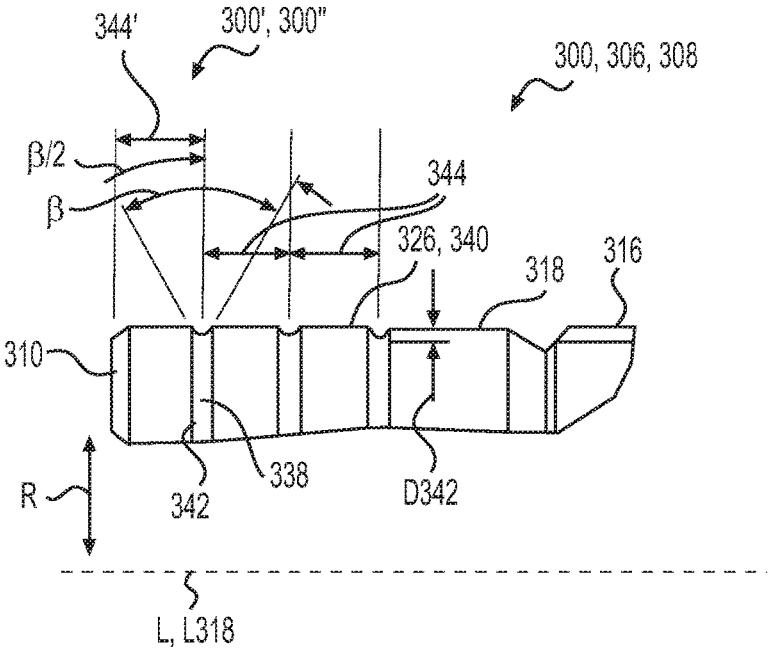

FIG. 8 is an enlarged side detail view of the collar portion of the tool retaining portion of the tool adapter of FIGS. 6 and 7.

Figure 9:
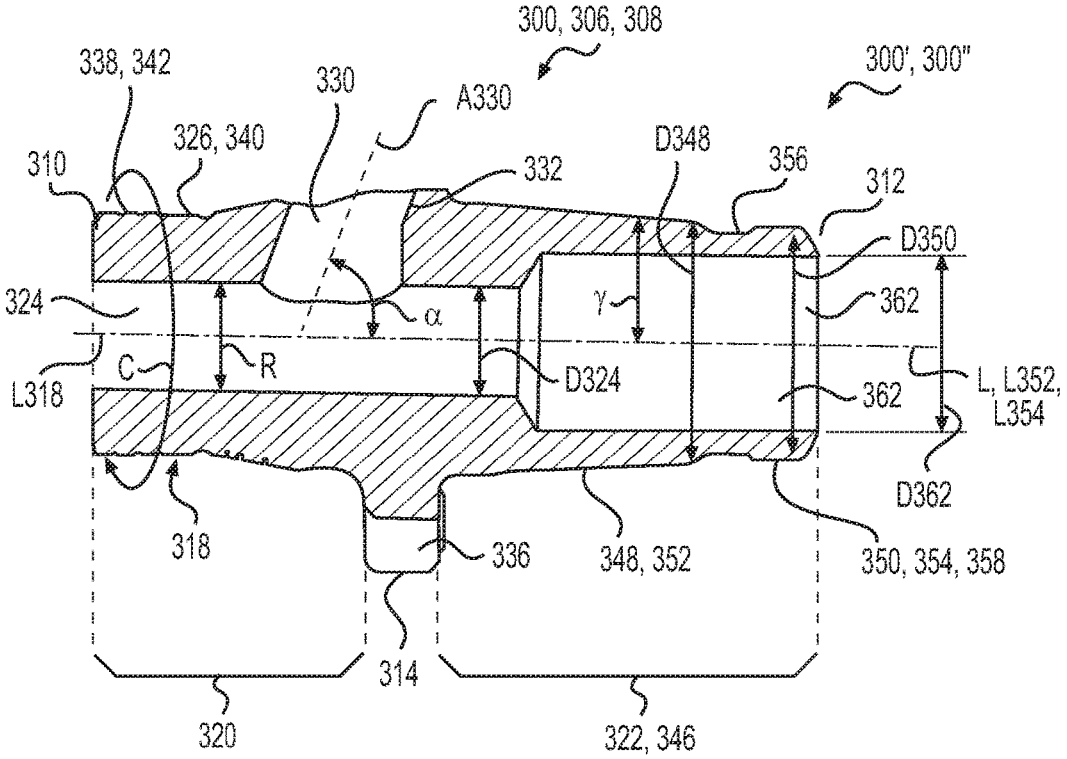

FIG. 9 is a side sectional view of the tool adapter of FIGS. 6 and 7.

Figure 10:
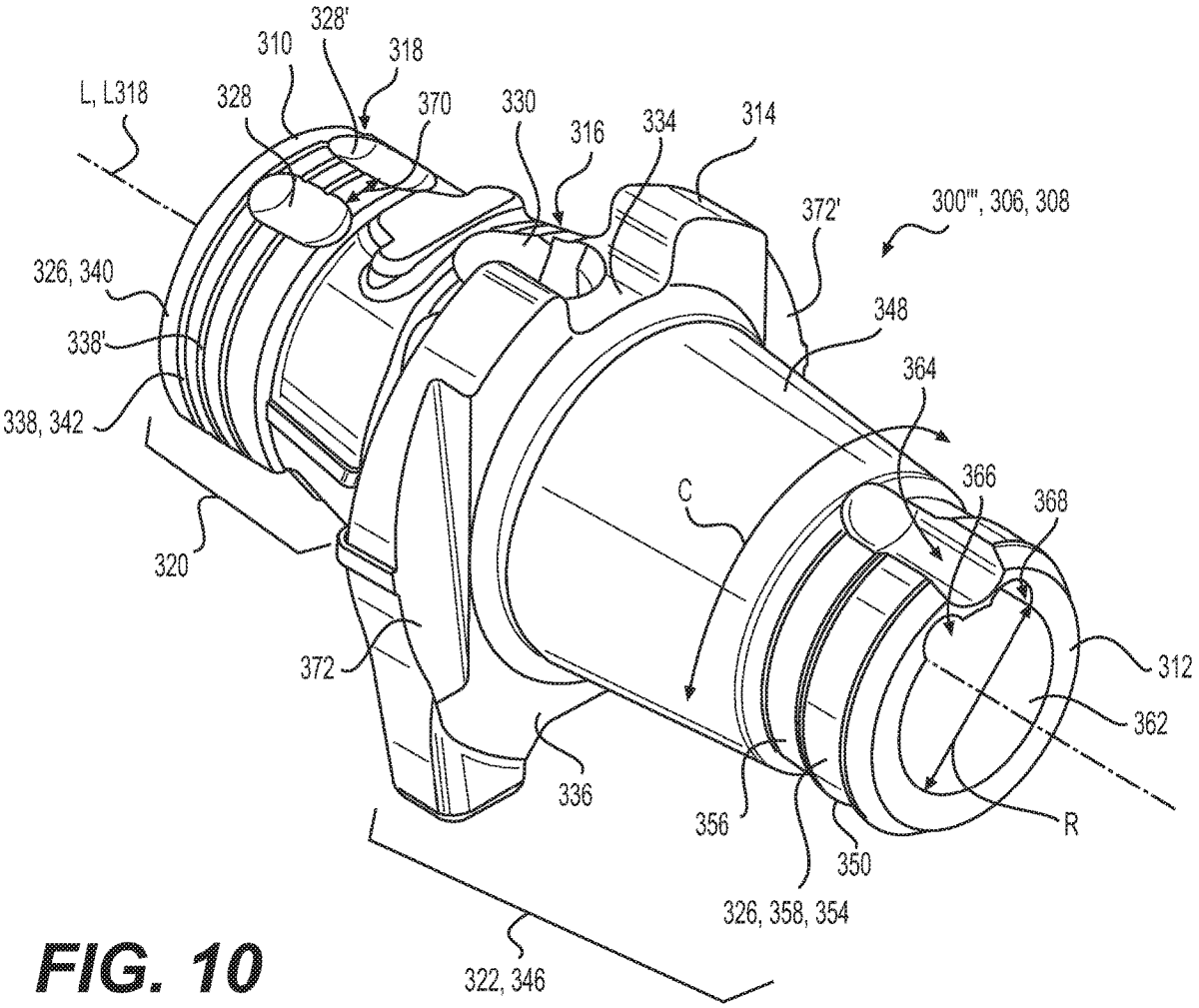

FIG. 10 is a perspective view of an alternate embodiment of a tool adapter of the present disclosure, showing an alternate shank end geometry of the shank of the tool adapter.

Figure 11:
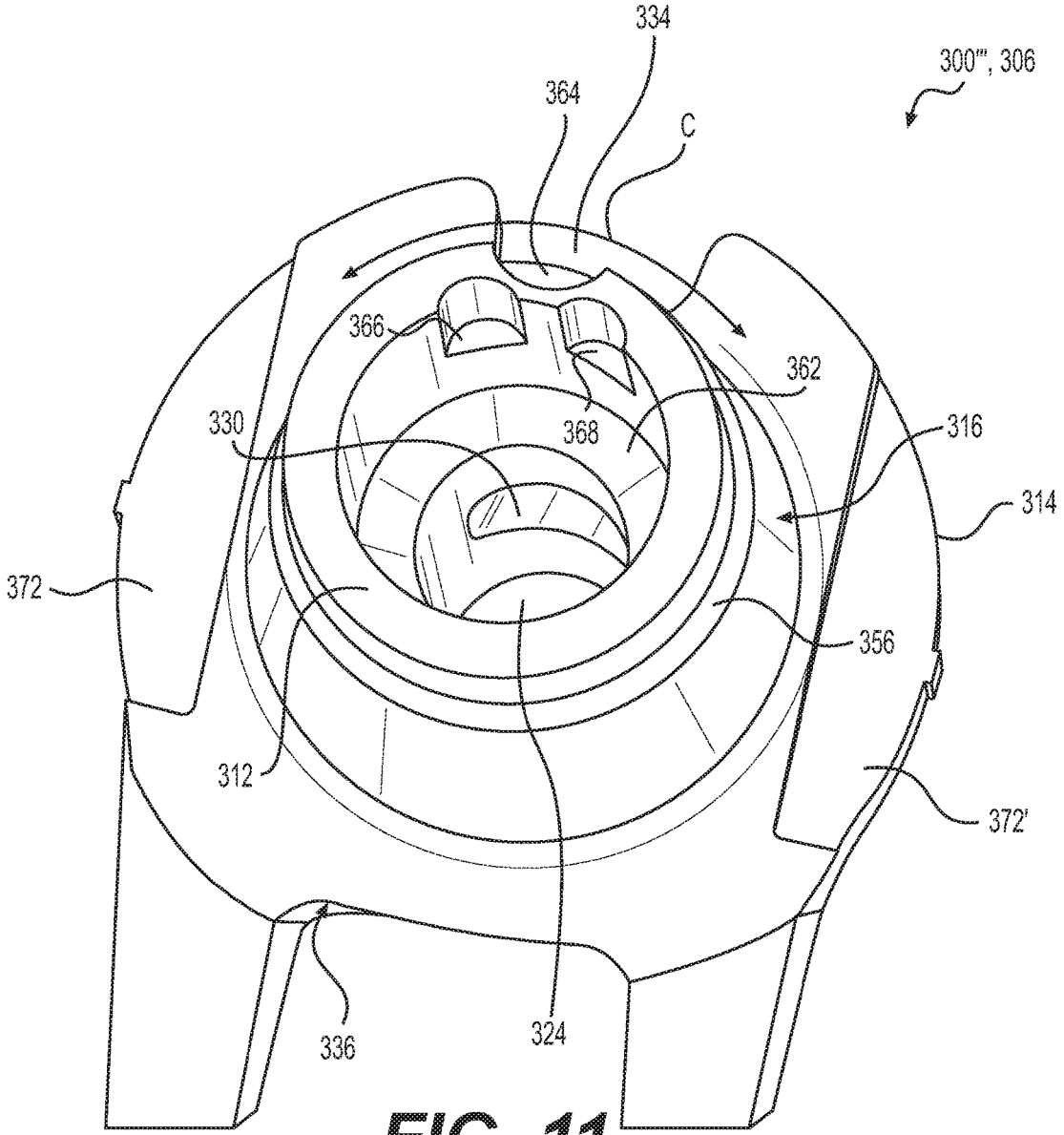

FIG. 11 is an alternate perspective view of the tool adapter of FIG. 10, showing more clearly how the third, fourth and fifth grooves thin out the wall of the non-tapered portion of the shank.

DETAILED DESCRIPTION

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* or by a prime for example, 100', 100" etc. It is to be understood that the use of letters or primes immediately after a reference number indicates that these features are similarly shaped and have similar function as is often the case when geometry is mirrored about a plane of symmetry. For ease of explanation in this specification, letters and primes will often not be included herein but may be shown in the drawings to indicate duplications of features, having similar or identical function or geometry, discussed within this written specification.

Various embodiments of an apparatus and a method will be described herein regarding a tool adapter, a cutting tool assembly, and a rotary cutting tool such as a rotary cutting drum assembly or the like will be described.

In some embodiments, the tool adapter has features to allow easy bit removal such as grooves on the wear collar that allow the operator to use an air chisel to directly disengage the bit after the wear collar has worn down, opening the ends of one or more grooves to allow access to the washer of the tool adapter. Also, a cross-slot in the tool adapter can also be used with air tools and a curved punch to press the tool bit out of the tool adapter by pressing on the shank of the tool bit. In addition to the function the cross-slot performs for bit removal, the cross-slot also may also allow water to directly enter the spring clip area of the bit and enhance rotation of the bit about its longitudinal axis while seated in the tool adapter, which may lead to a longer bit life.

In other embodiments, the collar of the tool adapter has rings or wear indicators that indicate the amount of wear that has happened on the tool adapter caused by the rotation of the rotary cutting tool. It is desirable that the collar wear occurs uniformly on all the tool adapters and that the operator can readily see this relative wear in order to keep the bits all cutting at the same depth. The body of the tool adapter may be made from tough or hardened steel that provides high hardness for wear while still having a high toughness.

In yet further embodiments, a tool adapter may provide features to increase the reliability of the retention system. More specifically, the tool adapter may provide a double retention system including a tapered or conical section of the shank that becomes press fitted into the base and a cylindrical or non-tapered section that may also be press fit into the base. Vibration from service work to the rotor or certain operating conditions is known to loosen tapered connections. The tool adapter may have a cylindrical press fit on the tail of the tool adapter that will remain engaged if vibration loosens the tapered connection. This allows the tapered connection to become reengaged the next time the rotor is used in normal running conditions.

It is contemplated that any of these embodiments with features regarding ease of serviceability, durability or reliability may be combined with other features for other desirable traits to yield a host of embodiments. In some embodiments, all the features discussed herein may be used simultaneously. In other embodiments, only select features may be used.

Figure 1:
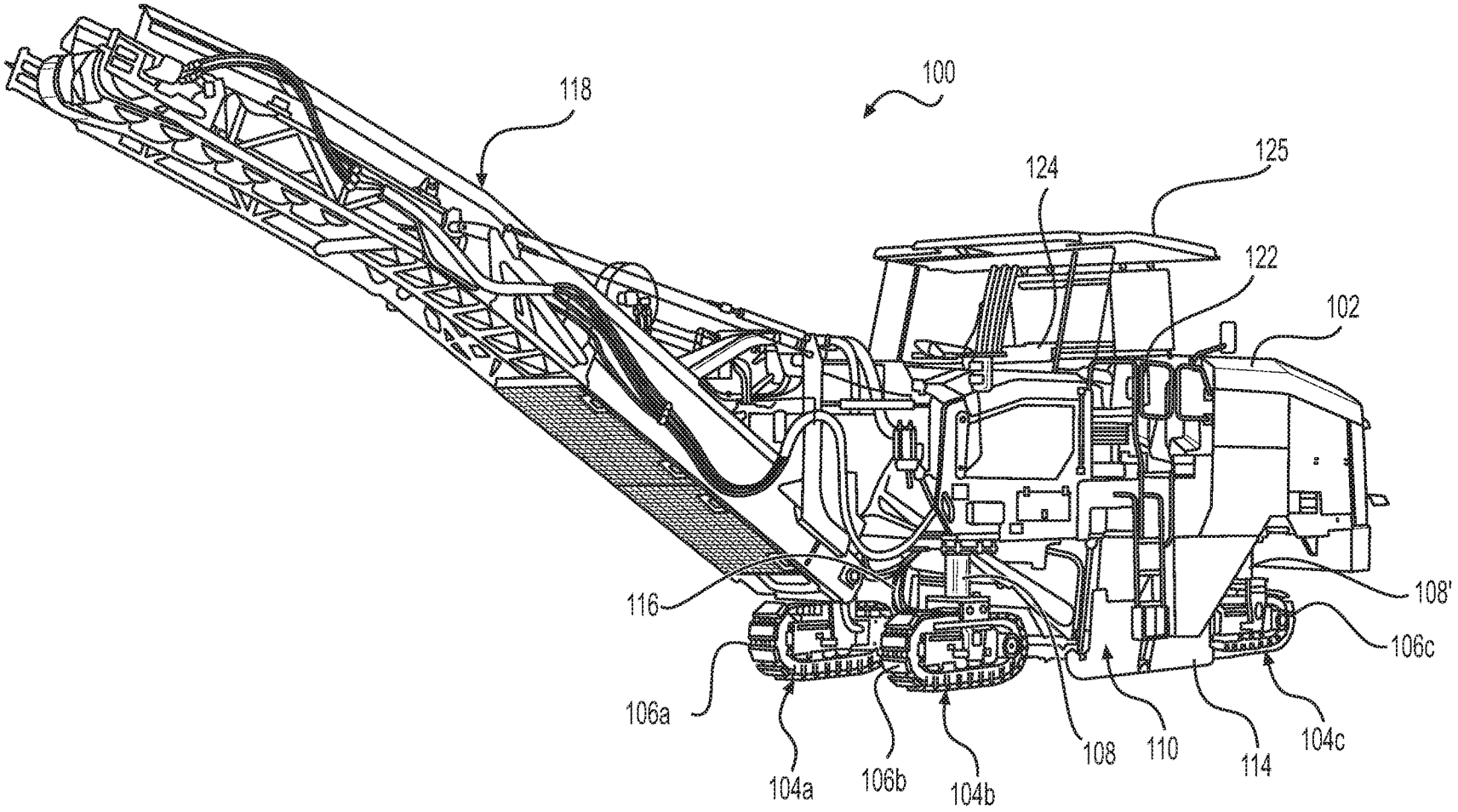
FIG. 1 is a perspective view of a machine that may use a tool adapter according to an embodiment of the present disclosure for attaching a tool such as a cutting tool bit to a rotary cutting drum assembly.

FIG. 1 illustrates an exemplary machine 100 having multiple systems and components that cooperate to accomplish a task. Machine 100 may embody a mobile machine that performs some type of operation associated with an industry such as mining, construction, farming or agriculture, transportation, earth moving, or any other known industry. For example, machine 100 may be a milling machine such as a cold planer. Machine 100 may include a power source 102 and one or more undercarriage assembly 104, which may be driven by power source 102.

Power source 102 may drive the undercarriage assembly (s) 104 of machine 100 at a range of output speeds and torques. Power source 102 may be an engine such as, for example, a diesel engine, a gasoline engine, a gaseous fuel-powered engine, or any other suitable engine. Power source 102 may also be a non-combustion source of power such as, for example, a fuel cell, a power storage device, or any other source of power known in the art.

Undercarriage assembly(s) 104 may include crawler tracks 106. The undercarriage assemblies 104 may be attached to the machine 100 via hydraulic cylinders 108 that may be raised or lowered or rotated to position the machine 100 both vertically or horizontally at a desired position relative to a work surface. Other types of undercarriages may be employed such as those employing wheels, walking mechanisms, etc.

An implement assembly 110, which includes a rotary cutting drum assembly 112 (best seen in FIG. 2), is shown to be attached to and extend from the bottom of the machine 100 in FIG. 1 such that it can hover a desired distance above the work surface. The implement assembly 110 includes two hydraulic side plates 114 (only one of which is shown in FIG. 1 but it is to be understood that a similar side plate is on the opposite side of the machine) with position sensors (not shown) used to monitor and position the rotary cutting drum assembly 112 (shown in FIG. 2). A cover plate (not shown in FIG. 1 or FIG. 2) extending between the side plates 114 is often employed to partially surround the rotary cutting drum assembly 112, being positioned above and to the rear of the cutting drum. A transmission (not shown in FIG. 1) may be operatively connected to the power source 102 and the rotary cutting drum assembly 112, allowing the power source 102 to drive the rotary cutting drum assembly 112 to rotate and rip up the work surface.

As shown in FIG. 1, the implement assembly 110 is fitted with hydraulic hoses 116 to feed water that is sprayed onto the rotary cutting drum assembly 112, helping to remove debris from the rotary cutting drum assembly 112 in use. This debris is diverted by the machine 100 to a foldable conveyor system 118 that transports the material to another vehicle or dump site where the discarded material is hauled away from the work area.

A cab 120 is also shown that houses a seat 122 and controls 124 for the operator to use to control the various functions of the machine 100. The configuration of this machine as well as the implement assembly 110 may be varied as needed or desired. The machine of FIG. 1 is provided by way of an example only as other types of machines are considered to be within the scope of the present disclosure.

Figure 2:
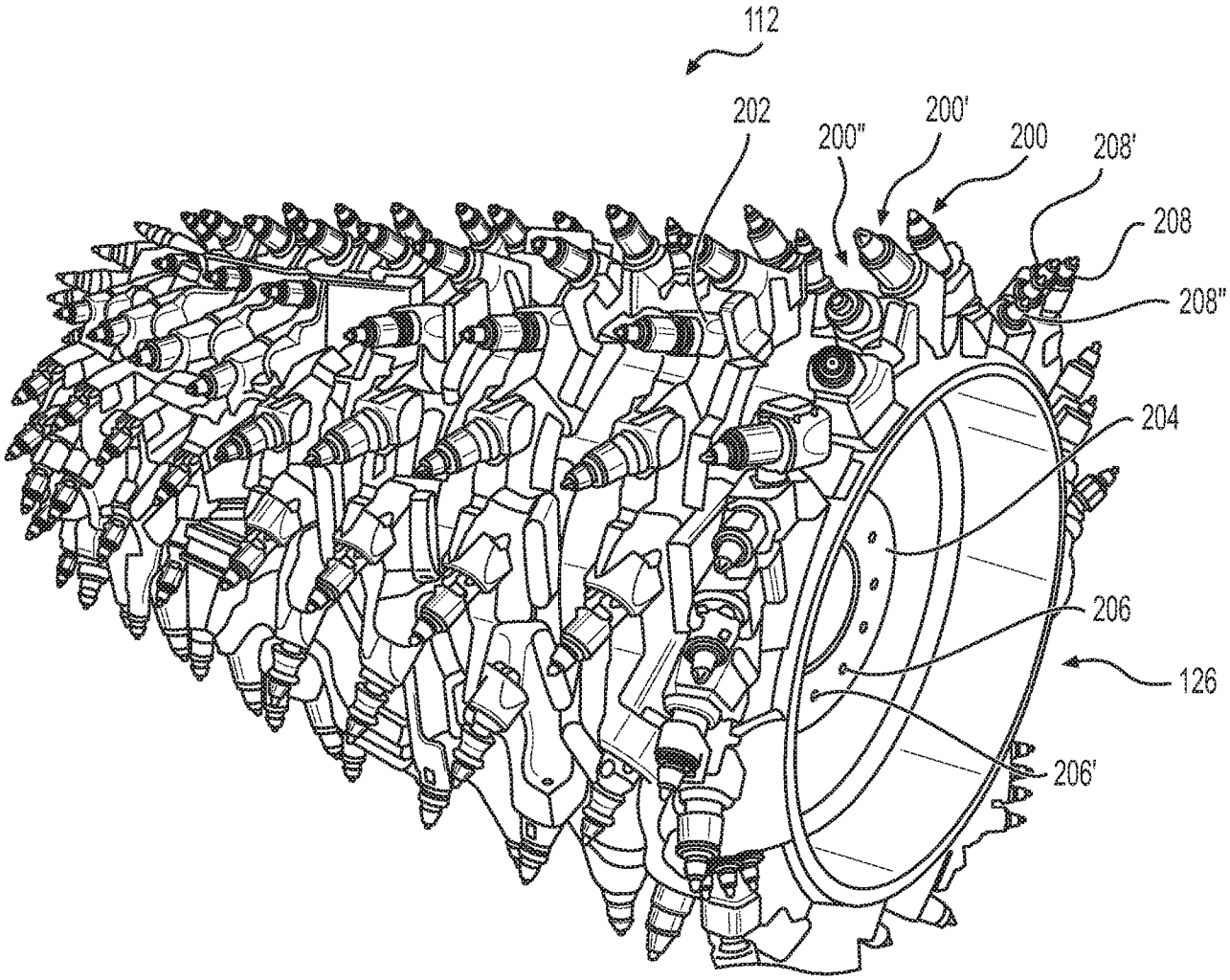
FIG. 2 is a perspective of the rotary cutting drum assembly of the machine of FIG. 1 removed from the machine illustrating a plurality of cutting tool assemblies attached to the cutting drum member.

Looking now at FIG. 2, the rotary cutting drum assembly 112 includes a substantially cylindrical drum member 126 with a plurality of cutting tool assemblies 200 attached to the drum member 126 about its circumference in a manner known in the art. For example, the cutting tool assemblies 200 may have a block or base 202, which is welded or otherwise adhered or fastened to the drum member 126. It is contemplated that the base 202 may be formed integrally with the drum member 126, having a unitary construction with the drum member 126. A series of bolt holes 206 are shown on the hub 204 of the drum member 126 that are used to attach the cutting drum member 126 to the implement assembly 110. The cutting tool assemblies 200 are shown to be attached to the cutting drum member 126 along a spiral path about the circumference of the drum member 126 with the cutting tool bit 208 of each cutting tool assembly 200 extending at a slightly different angle of attack than the adjacent cutting tool assembly 200' along the spiral path. It is contemplated that the arrangement, configuration, and angle of attack of each of the cutting tool assemblies may be varied as needed or desired.

FIG. 3 illustrates the cutting tool assembly 200 removed or isolated from the drum member 126. The cutting tool assembly 200 includes a base 202, which is usually attached to the drum member 126 as previously described, a tool adapter 300 that may be attached and detached from the base 202, and a cutting tool bit 208 that may be attached and detached from the tool adapter 300. The flange 314 of the tool adapter 300 defines a keyway 336 that mates with a key 228 on the base 202, helping to prevent rotation of the tool adapter 300 once attached to the base 202.

FIG. 4 is an exploded assembly view of the cutting tool assembly 200 illustrating how the cutting tool assembly 200 is assembled onto a drum member 126. First, the base 202 is attached via welding or in some other suitable manner as previously described onto the drum member 126. Then, the cutting tool bit 208 is assembled onto the tool adapter 300 by inserting its shank 218 into a complimentarily shaped aperture or bore 324 of the tool adapter 300, forming a subassembly. Then, the cutting tool bit 208 and tool adapter 300 are attached to the base 202 via the shank 302 of the tool adapter 300 that mates with the complimentarily shaped cavity 212 of the base 202. Alternatively, the tool adapter 300 may be attached first to the base 202 by inserting its shank 302 into the complimentarily shaped cavity 212 of the base 202. Then, the cutting tool bit 208 may be attached to the tool adapter 300 as just described. Disassembling the cutting tool assembly 200 may be accomplished by reversing one or more of these steps.

Figure 5:
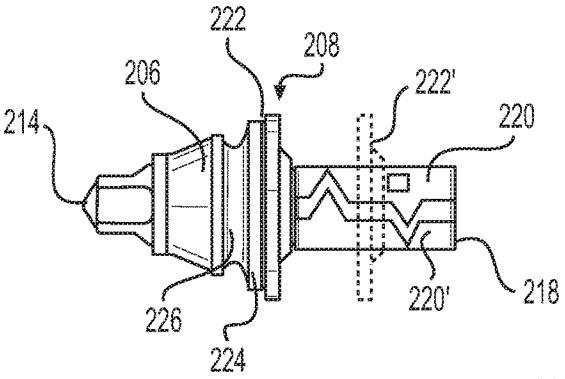
FIG. 5 is a side view of a cutting tool bit subassembly shown in isolation from the cutting tool assembly of FIGS.

Looking now at FIGS. 4 and 5, the cutting tool bit 208 is often an assembly that is designed to be attached to and detached from the tool adapter 300. The cutting tool bit 208 includes a tip 214 attached to the body 216. The tip 214 may be made of carbide, diamond, or other types of material depending on the application. The function of the tip 214 is to penetrate the desired working surface. A resilient or spring loaded shank 218 with movable halves 220 extends from the rear of the body 216 and a washer 222 is provided that rides up and down on the shank 218. The halves 220 of the shank 218 are naturally biased apart.

When the washer 222 is pulled down along the shank 218, these halves 220 are pulled together, effectively decreasing the diameter of the shank 218. This allows the shank of the tool bit 208 to be inserted into the tool receiving bore 324 of the tool adapter 300. As the cutting tool bit 208 is pressed further into the tool adapter 300, the washer 222 is forced in the opposite direction until it reaches the stop flange 224 of the body 216 of the tool bit. At this point, the washer 222 is no longer surrounding the shank 218 or restricting the diameter of the shank 218 of the tool bit 208, allowing the diameter to grow causing pressure to be exerted by the shank 218 on the wall of the tool receiving bore 324. This creates friction, holding the cutting tool bit 208 onto the tool adapter 300.

The body 216 of the tool bit 208 defines a groove 226 proximate the stop flange 224. An extraction tool (not shown) with a C-shaped head can be inserted into this groove. When force is applied to the handle of the extraction tool, the body 216 and shank 218 of the cutting tool bit 208 are forced forwards, away from the tool adapter 300, which then causes the washer 222 to once again surround the shank 218 of the cutting tool bit 208, causing the shank 218 to retract in diameter. This removes the pressure and the associated friction, allowing the tool bit 208 to be removed from the tool adapter 300.

It should be noted that the particulars of the cutting tool bit, its construction, configuration, method of assembly, etc. are provided by way of an example only and it is contemplated that other types of cutting tool bits may be used with any of the embodiments of the present disclosure.

Now, an embodiment of a tool adapter 300 according to an embodiment of the present disclosure with features related to ease of serviceability (i.e. ease of assembly and disassembly) will be described with reference to FIGS. 6 thru 9. The tool adapter 300 may comprise a body 306 including at least one elongated portion 308 defining a longitudinal axis L, a first end 310 and a second end 312 disposed along the longitudinal axis L, a flange 314 disposed between the first and second ends 310, 312 along the longitudinal axis L, and an exterior surface 316 extending along the longitudinal axis L. The elongated portion 308 may take the form of a collar portion 318 or "wear" collar that may be cylindrical, and the longitudinal axis L may be the cylindrical axis L318 of the collar portion 318 or may be coincident with the cylindrical axis L318. The longitudinal axis L of the body 306 may be defined by or be coincident with the axes of other portions of the body 306 as will be later described herein. In some cases, the longitudinal axis L is defined by the overall shape of the body as the body 306 extends from the first end 310 to the second end 312. The collar portion may have other configurations other than cylindrical in other embodiments.

The flange 314 may divide the body 306 into a tool retaining portion 320 disposed between the first end 310 and the flange 314, and a tool adapter attaching portion 322 disposed between the second end 312 and the flange 314. The tool retaining portion is so called as it is designed to retain a cutting tool bit or the like. Thus, this portion of the body defines a tool receiving bore 324 (see FIG. 9) extending from the first end 310 toward the second end 312 along the longitudinal axis L.

Returning to FIGS. 6 thru 9, the tool retaining portion 320 includes the collar portion 318 defining an outer collar surface 326. The body defines at least a first groove 328 disposed adjacent the first end 310 extending along the longitudinal axis L on the outer collar surface 326. As shown, two such grooves 328, 328' may be provided to allow an air chisel access to the tool bit so that the tool bit may directly disengage the tool bit from the tool adapter after the collar has worn away a certain amount. These grooves 328 may be similarly or identically configured (best seen in FIG. 7) with a width W328 in a direction parallel with a radial direction R and tangential to the circumferential direction C that may range from 5-15 mm and a length L328 along the longitudinal axis L that may range from 10-30 mm. The end of these grooves 328 is spaced away from the first end 310 but this may not be the case in other embodiments (i.e. the grooves may extend all the way to the first end, or close enough to be in communication with the first end). In addition, these grooves may extend in the opposite direction to the end of the wear collar or substantially close.

As best seen in FIG. 9 while also referencing FIGS. 6 and 7, the body 306 further defines a cross-slot 330 extending from the exterior surface 316 to the tool receiving bore 324 to provide another way to dislodge the tool bit using a curved punch or a similar tool. The cross-slot 330 defines an axis of extension A330, substantially parallel to its sidewalls 332, and the axis of extension A330 forms an acute angle $\alpha$ with the longitudinal axis L. In various embodiments, this angle $\alpha$ may range from 60 to 80 degrees, and may be approximately 70 degrees in certain embodiments (+/− 0.5 degree). As shown in FIGS. 6, 7 and 9, the cross-slot 330 may extend at least partially through the flange 314 or the area of the flange. To provide further clearance for inserting a tool into the cross-slot 330, a notch 334 is provided in the flange 314 at least partially circumscribing the entrance of the cross-slot 330. The width W330 of the cross-slot may range from 10-20 mm in various embodiments, and may be approximately 15 mm (+/− 0.5 mm) in some embodiments.

When this tool adapter 300 is new, the shank of the bit only goes partially into the cross-slot 330 so the user can use an air punch to directly knock out the bit thru the cross-slot 330. As the collar 318 wears back, the end of the shank moves further back into the cross-slot 330, making it more difficult to knock out the tool bit with air tools thru the cross-slot 330. Now, the end of the first groove 328 in the collar 318 is exposed to the washer 222, making it possible to remove the bits 208 by using a pneumatic punch directly against the washer 222.

Next, an embodiment of a tool adapter 300' according to an embodiment of the present disclosure with features related to wear detection or prevention will be described with reference to FIGS. 6 thru 9. This embodiment of a tool adapter 300' may comprise a body 306 including at least one elongated portion 308 defining a longitudinal axis L, a first end 310 and a second end 312 disposed along the longitudinal axis L, a flange 314 disposed between the first and second ends 310, 312 along the longitudinal axis L, and an exterior surface 316 extending along the longitudinal axis L. The longitudinal axis L may be defined in a manner stated earlier herein.

The flange 314 may divide the body 306 into a tool retaining portion 320 disposed between the first end 310 and the flange 314, and a tool adapter attaching portion 322 disposed between the second end 312 and the flange 314 as previously described. The tool adapter attaching portion is so called as this portion is inserted into the cavity of a base, attaching the tool adapter to the base.

Furthermore, the body 306 may define a tool receiving bore 324 extending from the first end 310 toward the second end 312 along the longitudinal axis L and a collar portion 318 disposed proximate the first end 310 including an outer surface 326 and at least one wear indicator 338 disposed on the outer surface 326 of the collar portion 318. For this embodiment, the collar portion has a substantially cylindrical configuration defining an outer circumferential surface 340, a circumferential direction C, and a radial direction R and the wear indicator 338 extends circumferentially and may extend completely circumferentially around the collar, forming a ring.

The wear indicator 338 may be proud (e.g. a rib) or recessed (e.g. a groove). For this embodiment, one or more of the wear indicators 338 may be a ring-shaped groove 342. A plurality of wear indicators 338 (e.g. three grooves) may be provided that are spaced along the longitudinal axis L on the outer surface 326 of the collar portion 318. As best seen in FIG. 8, the ring-shaped grooves 342 include a v-shaped configuration with a sixty degree included angle $\beta$ centered about the radial direction R in a plane defined by the radial and longitudinal directions R, L318 of the collar portion 318 and define a depth D342 of approximately 0.5 mm (+/− 0.1 mm) measured along the radial direction R. The plurality of wear indicators 338 are spaced from each other by a distance 344 that is approximately 4 mm (+/− 0.2 mm) measured along the longitudinal axis L318 and the wear indicator 338 disposed nearest the first end 310 is spaced away from the first end by a distance 344' that is also approximately 4 mm (+/− 0.2 mm). After one or more wear indicators 338 have been worn away and noticed by the user, the user may replace the tool adapter 300'.

In order to slow down the rate of wear, it is contemplated that the body may have a high surface hardness and a high toughness.

The timing or relative positioning of various features in some embodiments may be described as follows. The keyway 336 is positioned in a diametrically opposite manner to the cross-slot 330, the first and second grooves 328, 328', and the notch 334. So, when the tool adapter 300 is mated with the key 228 on the base 202, the cross-slot 330, the first and second grooves 328, 328', and notch 334 are on the top of the tool adapter 300 (see FIG. 3), allowing the user to more easily access these features of the tool adapter with maintenance tools. Regardless of the positioning of the keyway or if such a feature is provided, the first and second grooves may be positioned on the same side of the tool adapter as the cross-slot. Put another way, the first and second grooves may be said to be substantially aligned circumferentially with the cross-slot.

An embodiment of a tool adapter 300" according to an embodiment of the present disclosure with features related to reliability will now be described with reference to FIGS. 6 thru 9. The tool adapter 300" may comprise a body 306 including at least one elongated portion 308 defining a longitudinal axis L, a first end 310 and a second end 312 disposed along the longitudinal axis L, a flange 314 disposed between the first and second ends 310, 312 along the longitudinal axis L, and an exterior surface 316 extending along the longitudinal axis L. Again, the longitudinal axis L may be defined by or be associated with various portions of the body 306 as previously described.

The flange 314 divides the body 306 into a tool retaining portion 320 disposed between the first end 310 and the flange 314, and a tool adapter attaching portion 322 disposed between the second end 312 and the flange 314. The body 306 defines a tool receiving bore 324 extending from the first end 310 toward the second end 312 along the longitudinal axis L and the tool adapter attaching portion 322 includes a shank 346 including a tapered portion 348 and a non-tapered portion 350. The flange 314 helps to prevent the shank 346 from entering too deep into the cavity 212 of the base 202 (best seen in FIG. 3). That is to say, the tapered portion 348 and non-tapered portion 350 are often used to produce a press-fit. If the shank 346 is pressed in too far, the tool adapter 300" may become stuck or create too much stress in the base 302 of the cutting tool assembly 200.

With continued reference to FIGS. 6 thru 9, the tapered portion 348 includes an outer conical portion 352 with a conical axis L352, and the non-tapered portion 350 includes an outer cylindrical portion 354 being disposed immediately adjacent the second end 312 and the outer conical portion 352 is disposed between the flange 314 and the outer cylindrical portion 354. The outer cylindrical portion 354 defines a cylindrical axis L354. Either of the conical or cylindrical axes L352, L354 may define the longitudinal axis L or be coincident therewith. The taper angle γ (see FIG. 9) of the conical portion 352 may range from 2-7 degrees, and may be approximately 4.5 degrees in some embodiments.

Referring to FIGS. 6, 7 and 9, the body 306 may define a separating or clearance groove 356 separating the outer conical portion 352 from the outer cylindrical portion 354. Also, the outer cylindrical portion 352 may define an outer cylindrical surface 358 and at least one flat 360 extending along the cylindrical axis L354 on the outer cylindrical surface 358 of the outer cylindrical portion 354. The body 306 may define a shank bore 362 extending from the second end 312 to the tool receiving bore 324 being in communication therewith. A plurality of flats are shown to be provided such as eight flats. The size, shape, number and placement of these flats may be varied as needed or desired.

In some embodiments such as the one shown in FIGS. 10 and 11, the body 306 may define a third groove 364 on the surface 326, 358 of the cylindrical portion 354. The third groove 364 extends from the second end 312 and a fourth groove 366 and a fifth groove 368 also extend longitudinally from the second end 312 that are in communication with the shank bore 362. The fourth and fifth grooves 366, 368 straddle the third groove 364 along the circumferential direction C.

For the embodiment shown in FIG. 6, the flat 360 reduces the press fit area, easing assembly and disassembly. For the embodiment shown in FIGS. 10 and 11, the arrangement of the third, fourth and fifth grooves 364, 366, 368 thins out the wall of the cylindrical portion 354, making it more flexible, which also may ease press-fitting. To that end, the depth of these grooves 364, 366, 368 extend longitudinally to the clearance groove 356 or even therewith, thereby thinning out the cylindrical wall as much as desired longitudinally. It is contemplated that in other embodiments, groove 364 may extend radially completely through the wall of the cylindrical portion, thereby eliminating the need for the fourth and fifth grooves to make the wall of the cylindrical portion suitably pliant.

As best seen in FIG. 9, the shank bore 362 and the tool receiving bore 324 may both be substantially cylindrically shaped and be concentric with the longitudinal axis L of the body 306 of the tool adapter 300. For the embodiments shown in FIGS. 6 thru 10, all the various portions of the body 306 of the tool adapter 306 including the collar portion 318, the conical portion 352, the cylindrical portion 354, the tool receiving bore 324 and the shank bore 362 are created by revolving the geometry about the longitudinal axis L of the body 306. The diameter D362 of the shank bore 362 may be greater than the diameter D324 of the tool receiving bore 324. This may not be the case for other embodiments.

The arrangement, function, and dimensions of the various features of any embodiment of a tool adapter as discussed herein may be altered as needed or desired.

INDUSTRIAL APPLICABILITY

In practice, a tool adapter, a cutting tool assembly, a rotary cutting tool assembly, an implement assembly or a machine using a tool adapter according to any embodiment described herein may be sold, bought, manufactured or otherwise obtained in an OEM or after-market context.

Thus far, various embodiments have been discussed focusing on particular features associated with certain desirable traits. Focusing now on FIGS. 10 and 11, with reference to FIG. 9, an embodiment of a tool adapter 300'" that incorporates multiple features associated with a plurality of desirable traits will now be described. It is to be understood that the embodiment of FIGS. 10 and 11 is similarly or identically configured to the embodiments shown in FIGS. 6 thru 9 except that the geometry nearest the tail end or second end 312 of the body 306 is slightly different.

This embodiment of a tool adapter 300'" may comprise a body 306 including at least one elongated portion 308 defining a longitudinal axis L, a first end 310 and a second end 312 disposed along the longitudinal axis L, a flange 314 disposed between the first and second ends 310, 312 along the longitudinal axis L, and an exterior surface 316 extending along the longitudinal axis L.

The flange 314 divides the body 306 into a tool retaining portion 320 disposed between the first end 310 and the flange 314, and a tool adapter attaching portion 322 disposed between the second end 312 and the flange 314. The body 306 also defines a tool receiving bore 324 extending from the first end 310 toward the second end 312 along the longitudinal axis L and a cylindrical collar portion 318 disposed proximate the first end 310 including an outer collar surface 326, 340 and at least one wear indicator 338 disposed on the outer collar surface 326, 340 of the collar portion 318. This cylindrical collar portion 318 defines a circumferential direction C and a radial direction R and the body 306 defines a first groove 328 and a second groove 328' disposed adjacent the first end 310 extending along the longitudinal axis L on the outer collar surface 326, 340, said first and second grooves 328, 328' being spaced away from each other along a direction parallel with the radial direction R and tangential to the circumferential direction C. This distance 370 may range from 3-8 mm for certain embodiments. For this embodiment, the first and second groove extend along the majority of the longitudinal length of the collar. As a result, these grooves interrupt one or more of the wear indicators. More specifically, the first and second grooves interrupt all three of the ring-shaped grooves, which act as the wear indicators. This arrangement may be different in other embodiments.

The tool adapter attaching portion 322 includes a shank 346 having a tapered portion 348 disposed adjacent the flange 314 along the longitudinal axis L and a non-tapered portion 350 disposed adjacent the second end 312 along the longitudinal axis L. The body 306 further defines a cross-slot 330 extending from the exterior surface 316 to the tool receiving bore 324 and a clearance groove 356 disposed between the tapered portion 348 and non-tapered portion 350 along the longitudinal axis L. The tapered portion 348 includes a conical configuration concentric with the longitudinal axis L and the non-tapered portion 350 includes a cylindrical configuration concentric with the longitudinal axis L. Other configurations for the tapered and non-tapered portions are possible. As best seen in FIG. 9, the tapered portion 348 with a conical configuration defines a first minimum diameter D348 along the longitudinal axis L and the non-tapered portion 350 defines a first maximum diameter D350 that is less than the first minimum diameter D348.

The body further defines a flat 360 (see FIG. 7) or third groove 364 (see FIGS. 10 and 11) on the non-tapered portion 350 that extends approximately from the second end 312 to the clearance groove 356, that is to say, the third groove is in communication with the second end 312 and the clearance groove 356. The flat 360 may measure a distance D360 that ranges from 7-9 mm along a direction tangential to the circumferential direction C while the third groove 364 may measure 7-14 mm along the same direction. As best seen in FIG. 11, fourth and fifth grooves 366, 368 may be provided on either side of the third groove 364 circumferentially to thin out the wall of the non-tapered portion 350 of the shank 346 of the tool adapter 300, making that area more flexible or resilient so assembly and disassembly of the tool adapter into a base is eased.

As mentioned previously, the body 306 in FIG. 10 defines at least a first and a second wear indicator 338, 338' and the first wear indicator 338 is disposed between the first end 310 and the second wear indicator 338'. The first wear indicator 338 is spaced away from the first end 310 a first distance along the longitudinal axis L and the first wear indicator 338 is spaced away from the second wear indicator 338' a second distance along the longitudinal axis L and the first and second distances are approximately the same (as previously explained with reference to FIG. 8).

The cross-slot 330 extends at least partially through the flange 314 or the area of the flange defining an entrance and the flange 314 defines a notch 334 that at least partially surrounds the entrance of the cross-slot 330. The flange 314 defines at least one pry slot 372 disposed between the flange 314 and the tool adapter attaching portion 322 along the longitudinal axis L. For the embodiment shown in the figures, two such pry slots 372 are provided in a diametrically opposite fashion and these pry slots are out of phase circumferentially with the cross-slot 330 and the keyway 336 by ninety degrees. The body of the tool adapters of FIGS. 6 and 10 are symmetrical about a plane 374 shown in FIG. 7. The features of the embodiment shown in FIGS. 6 thru 10 may be used as follows. The pry slots may have an angled surface (reference numeral 372 points to this surface in FIG. 6) relative to the longitudinal axis forming an angle (similar to angle $\alpha$ shown in FIG. 9) that is approximately 100 degrees. This allows an implement to be used against this angled surface to dislodge the tool adapter from the base.

If a tool bit wears down or it becomes desirable to change the tool bit for any reason, the first and second grooves or cross-slot may be used to remove the tool bit from the tool adapter. On the other hand, if the tool adapter becomes worn, it may be removed from the base using the pry slots located on the flange of the tool adapter using a prying tool. Water used to remove debris from an implement assembly may cause the tool bit to rotate about the longitudinal axis of the tool adapter by entering the cross-slot and impinging on the tool bit. This may promote even wear of the tool bit over the course of its useful life. When installing the tool adapter, the tapered and non-tapered sections may cooperate to aid in assembly and disassembly and preventing the unwanted loosening of the tool adapter to the point where the tool adapter may fall off the base of a cutting tool assembly over time.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, it is intended that the specification and examples be considered as exemplary only, with a true scope and spirit of the invention(s) being indicated by the following claims and their equivalents.

What is claimed is:

1. A tool adapter comprising:

a body including at least one elongated portion defining a longitudinal axis, a first end and a second end disposed along the longitudinal axis, a flange disposed between the first and second ends along the longitudinal axis, and an exterior surface extending along the longitudinal axis;

wherein the flange divides the body into a tool retaining portion disposed between the first end and the flange, and a tool adapter attaching portion disposed between the second end and the flange, and the body defines a tool receiving bore extending from the first end toward the second end along the longitudinal axis and a cylindrical collar portion disposed proximate the first end including an outer collar surface and at least one wear indicator disposed on the outer collar surface of the collar portion;

the cylindrical collar portion defining a circumferential direction and a radial direction and the body defines a first groove and a second groove disposed adjacent and spaced away from the first end, the first and second groove extending along the longitudinal axis on the outer collar surface, said first and second grooves being spaced away from each other along a direction tangential to the circumferential direction;

the tool adapter attaching portion including a shank having a tapered portion disposed adjacent the flange along the longitudinal axis and a non-tapered portion disposed adjacent the second end along the longitudinal axis, the shank also defining a shank bore; and the body further defining a cross-slot extending from the exterior surface to the tool receiving bore and a clearance groove disposed between the tapered portion and non-tapered portion along the longitudinal axis.

2. The tool adapter of claim 1 wherein the tapered portions includes a conical configuration concentric with the longitudinal axis and the non-tapered portion includes a cylindrical configuration concentric with the longitudinal axis.

3. The tool adapter of claim 2 wherein the body further defines a flat on the non-tapered portion that extends approximately from the second end to the clearance groove along the longitudinal axis.

4. The tool adapter of claim 2 wherein the body further defines a third groove on the non-tapered portion that extends approximately from the second end to the clearance groove along the longitudinal axis and is in communication with the second end and the clearance groove.

5. The tool adapter of claim 1 wherein the body further defines a second wear indicator and the first wear indicator is disposed between the first end and the second wear indicator, and the first wear indicator is spaced away from the first end a first distance along the longitudinal axis and the first wear indicator is spaced away from the second wear indicator a second distance along the longitudinal axis and the first and second distances are approximately the same.

6. The tool adapter of claim 1 wherein the cross-slot extends at least partially through the area of the flange defining an entrance and the flange defines a notch that at least partially surrounds the entrance of the cross-slot.

7. The tool adapter of claim 2 wherein the tapered portion with a conical configuration defines a first minimum diameter along the longitudinal axis and the non-tapered portion defines a first maximum diameter along the longitudinal axis that is less than the first minimum diameter.

8. The tool adapter of claim 1 wherein the flange defines at least one pry slot disposed between the flange and the tool adapter attaching portion along the longitudinal axis.

9. The tool adapter of claim 4 wherein the body further defines a fourth groove and a fifth groove extending longitudinally from the second end that are in communication with the shank bore, the fourth and fifth grooves also straddling the third groove along the circumferential direction.

10. The tool adapter of claim 1 wherein the shank bore defines a shank bore diameter and the tool receiving bore defines a tool receiving diameter and the shank bore diameter is greater than the tool receiving bore diameter.

11. The tool adapter of claim 1 wherein the flange defines a keyway that is disposed in a diametrically opposite manner to the cross-slot.

12. The tool adapter of claim 11 wherein the flange further defines a pry slot that is out of phase circumferentially with the keyway and the cross-slot by approximately ninety degrees.

13. A tool adapter for attaching tools to a rotary tool, the tool adapter comprising:

a body including at least one elongated portion defining a longitudinal axis, a first end and a second end disposed along the longitudinal axis, a flange disposed between the first and second ends along the longitudinal axis, and an exterior surface extending along the longitudinal axis; and wherein the flange divides the body into a tool retaining portion disposed between the first end and the flange, and a tool adapter attaching portion disposed between the second end and the flange, and the body defines a tool receiving bore extending from the first end toward the second end along the longitudinal axis and the tool retaining portion includes a collar portion defining a collar outer surface and the body defines a first groove disposed adjacent the first end extending along the longitudinal axis on the outer collar surface along the majority of the longitudinal length of the collar portion, the first groove being spaced away from the first end.

14. The tool adapter of claim 13 wherein the body further defines a cross-slot extending from the exterior surface to the tool receiving bore, the cross-slot being substantially aligned circumferentially with the first groove.

15. A tool adapter for attaching tools to a rotary tool, the tool adapter comprising:

a body including at least one elongated portion defining a longitudinal axis, a first end and a second end disposed along the longitudinal axis, a flange disposed between the first and second ends along the longitudinal axis, and an exterior surface extending along the longitudinal axis; and wherein the flange divides the body into a tool retaining portion disposed between the first end and the flange, and a tool adapter attaching portion disposed between the second end and the flange, and the body defines a tool receiving bore extending from the first end toward the second end along the longitudinal axis and the tool adapter attaching portion includes a shank including a tapered portion and a non-tapered portion;

the tapered portion includes an outer conical portion that defines a conical axis and a circumferential direction, and the non-tapered portion includes an outer cylindrical portion being disposed immediately adjacent the second end and the outer conical portion is disposed between the flange and the outer cylindrical portion; and the body defines a separating groove separating the outer conical portion from the outer cylindrical portion, the separating groove defining a separating groove diameter that is closer to the longitudinal axis than any portion of the outer conical portion or any portion the outer cylindrical portion.

16. The tool adapter of claim 15 wherein the outer cylindrical portion defines a maximum diameter and the outer conical portion defines a minimum diameter and the minimum diameter of the conical portion is greater than the maximum diameter of the cylindrical portion.

17. The tool adapter of claim 15 wherein the shank defines a shank bore having a shank bore diameter and the tool receiving bore defines a tool receiving bore diameter and the shank bore diameter is greater than the tool receiving bore diameter.

18. The tool adapter of claim 15 wherein the outer cylindrical portion defines an outer cylindrical surface and at least one groove or flat extending along the cylindrical axis on the outer cylindrical surface of the outer cylindrical portion.

* * * * *